US008561590B1

(12) United States Patent
Spix

(10) Patent No.: US 8,561,590 B1
(45) Date of Patent: Oct. 22, 2013

(54) OIL PAN FOR AN INTERNAL COMBUSTION ENGINE

(71) Applicant: GM Global Technology Operations LLC, Detroit, MI (US)

(72) Inventor: Thomas A. Spix, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 13/654,471

(22) Filed: Oct. 18, 2012

(51) Int. Cl.
*F02B 77/00* (2006.01)

(52) U.S. Cl.
USPC ..... 123/195 C; 123/198 DA; 123/198 E; 123/196 R; 184/106

(58) Field of Classification Search
USPC ..... 123/195 C, 196 R, 198 DA, 198 E; 184/106
See application file for complete search history.

(56) References Cited

U.S. PATENT DOCUMENTS

| | | | | |
|---|---|---|---|---|
| 5,601,060 | A * | 2/1997 | Smietanski et al. | 123/195 C |
| 6,640,767 | B2 * | 11/2003 | Kato et al. | 123/195 C |
| 7,240,657 | B2 * | 7/2007 | Watanabe | 123/196 R |
| 7,299,781 | B2 * | 11/2007 | Nakada et al. | 123/196 R |
| 8,075,772 | B2 * | 12/2011 | Suga | 210/232 |

* cited by examiner

*Primary Examiner* — Noah Kamen
*Assistant Examiner* — Grant Moubry
(74) *Attorney, Agent, or Firm* — Quinn Law Group, PLLC

(57) ABSTRACT

An oil pan for an internal combustion engine includes a flange configured for attaching to the internal combustion engine, and a floor spaced apart from the flange by a first distance and configured for collecting an oil thereon. The oil pan further includes a wall interconnecting the flange and the floor and defining at least one passage therein, wherein the at least one passage extends from the flange towards the floor to a second distance that is less than the first distance. In addition, the oil pan includes at least one insert insertable into the at least one passage to a third distance that is less than the second distance to thereby define an oil drainback channel that is configured for draining the oil from the internal combustion engine to the floor.

18 Claims, 4 Drawing Sheets

OIL PAN FOR AN INTERNAL COMBUSTION ENGINE

TECHNICAL FIELD

The disclosure relates to oil pans, and more specifically, to an oil pan for an internal combustion engine.

BACKGROUND

Internal combustion engines may be lubricated by an oil. During operation of the internal combustion engine, the oil may circulate within the internal combustion engine to lubricate moving components of the internal combustion engine, dissipate thermal energy, and protect against premature wear of the internal combustion engine.

SUMMARY

An oil pan for an internal combustion engine includes a flange configured for attaching to the internal combustion engine, and a floor spaced apart from the flange by a first distance and configured for collecting an oil thereon. The oil pan further includes a wall interconnecting the flange and the floor and defining at least one passage therein, wherein the at least one passage extends from the flange towards the floor to a second distance that is less than the first distance. In addition, the oil pan includes at least one insert insertable into the at least one passage to a third distance that is less than the second distance to thereby define an oil drainback channel that is configured for draining the oil from the internal combustion engine to the floor.

In one embodiment, the wall defines three passages therein, wherein each of the three passages extends from the flange towards the floor to a second distance that is less than the first distance. The wall further defines an auxiliary duct therein, wherein the auxiliary duct extends from the flange towards the floor to an intermediate distance that is less than the second distance. In addition, the oil pan includes three inserts each insertable into a respective one of the three passages to a third distance that is less than the second distance to thereby define three oil drainback channels each configured for draining the oil from the internal combustion engine to the floor. The oil pan also includes an auxiliary element insertable into the auxiliary passage to a fourth distance that is greater than the intermediate distance and less than the first distance to thereby define an auxiliary oil drainback channel configured for draining the oil from the internal combustion engine to the floor.

In another embodiment, the oil pan includes a flange configured for attaching to the internal combustion engine, and a floor spaced apart from the flange by a first distance and configured for collecting an oil thereon. The oil includes a frothy portion having a first degree of aeration, and an unadulterated portion disposed between the frothy portion and the floor and having a second degree of aeration that is less than the first degree of aeration. Further, the oil pan includes a wall interconnecting the flange and the floor such that the floor and the wall together define a cavity configured for containing the oil. The wall defines at least one passage therein extending from the flange towards the floor to a second distance that is less than the first distance. The oil pan also includes at least one insert insertable into the at least one passage to a third distance that is less than the second distance to thereby define an oil drainback channel that is configured to drain the unadulterated portion from the internal combustion engine to the floor. The at least one insert has a first end that abuts the flange when the at least one insert is inserted into the at least one passage, and a second end spaced apart from the first end. In addition, the second end and the floor together define a drain hole configured for transmitting the unadulterated portion from the at least one oil drainback channel to the floor when the at least one insert is inserted into the at least one passage.

The detailed description and the drawings or Figures are supportive and descriptive of the disclosure, but the scope of the disclosure is defined solely by the claims. While some of the best modes and other embodiments for carrying out the claims have been described in detail, various alternative designs and embodiments exist for practicing the disclosure defined in the appended claims.

DETAILED DESCRIPTION

Figure 1:
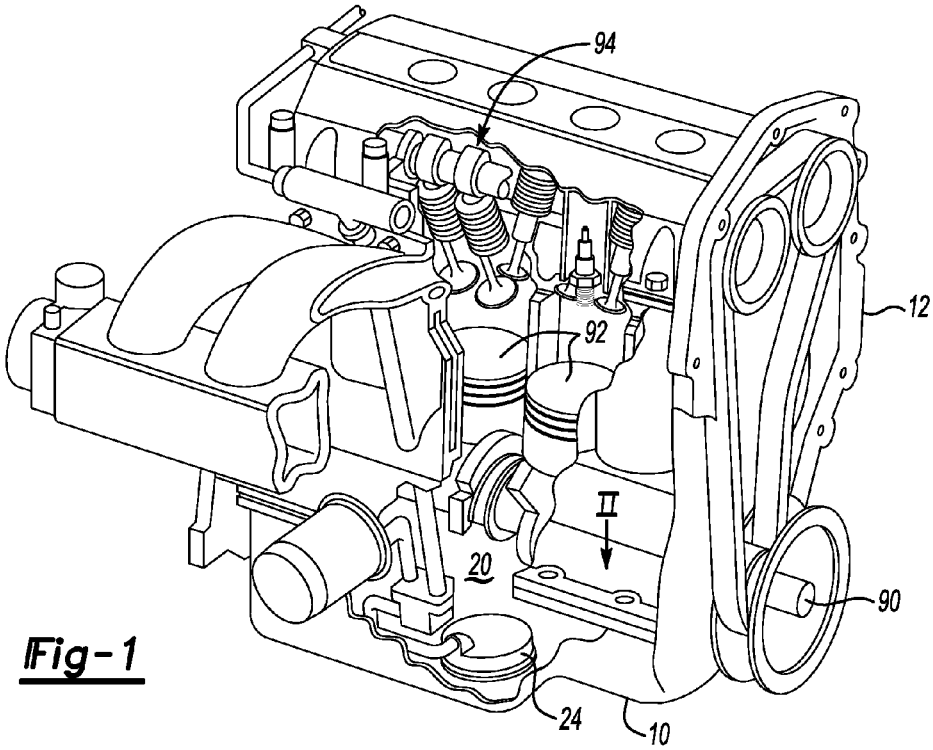
FIG. 1 is a schematic perspective illustration of a cutaway view of an internal combustion engine including an oil pan attached thereto.

Referring to the Figures, wherein like reference numerals refer to like elements, an oil pan 10 for an internal combustion engine 12 is shown generally in FIG. 1. The oil pan 10 may be useful for vehicles, such as automotive vehicles, that require a minimally-aerated oil 14 (FIG. 8) for lubrication of the internal combustion engine 12. However, the oil pan 10 may also be useful for non-automotive applications including, for example, marine and aviation applications.

Figure 2:
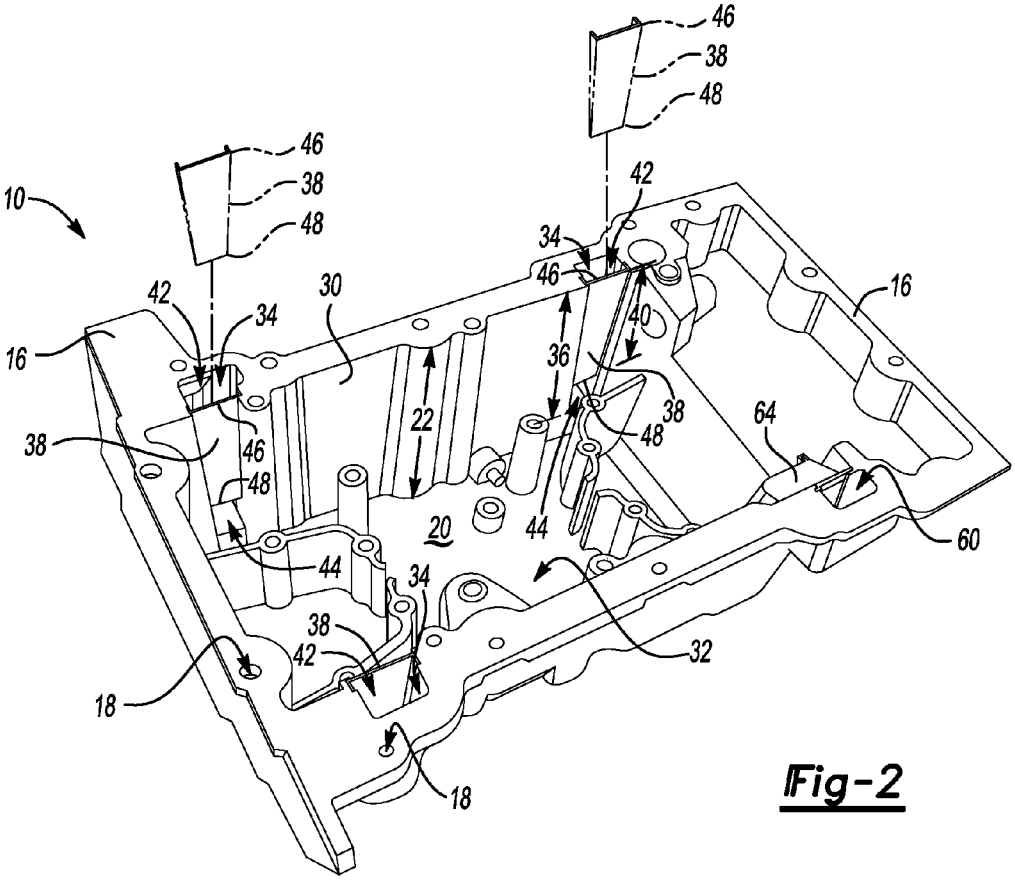
FIG. 2 is a schematic perspective exploded illustration of the oil pan of FIG. 1 as viewed from position II, wherein the oil pan includes a plurality of inserts insertable into a respective one of a plurality of passages, and further includes an auxiliary element inserted into an auxiliary duct.

As described with reference to FIGS. 1 and 2, the oil pan 10 includes a flange 16 (FIG. 2) configured for attaching to the internal combustion engine 12 (FIG. 1). For example, the oil pan 10 may be bolted to the internal combustion engine 12 so that the flange 16 abuts a bottom portion of the internal combustion engine 12. That is, during operation of the internal combustion engine 12, the oil pan 10 may be disposed beneath the internal combustion engine 12, as shown generally in FIG. 1, so as to provide an oil reservoir for the internal combustion engine 12. As such, as best shown in FIG. 2, the flange 16 may define a plurality of holes 18 configured for receiving a respective one of a plurality of bolts (not shown). Further, although not shown, the flange 16 may be sealingly mated to the internal combustion engine 12 during operation of the internal combustion engine 12. For example, a gasket or seal (not shown) that is configured to seal the oil pan 10 to the internal combustion engine 12 may be disposed between the flange 16 and the internal combustion engine 12.

Referring again to FIG. 2, the oil pan 10 also includes a floor 20 spaced apart from the flange 16 by a first distance 22 and configured for collecting the oil 14 (FIG. 8) thereon. That is, the first distance 22 defines a depth of the oil pan 10, and the oil 14 may recirculate through the internal combustion engine 12 (FIG. 1) to the floor 20 of the oil pan 10 during operation of the internal combustion engine 12, as set forth in more detail below. The floor 20 may be generally parallel to the flange 16, or may be sloped or angled with respect to the flange 16 to aid in oil pickup. Further, the floor 20 may support an oil pickup apparatus (shown generally at 24 in FIGS. 1 and 8) configured to retrieve the oil 14 from the floor 20 for circulation through the internal combustion engine 12.

With continued reference to FIG. 2, the oil 14 (FIG. 8) may be stratified into a plurality of portions or layers (shown generally at 26 and 28 in FIG. 8), and may return to the floor 20 of the oil pan 10 after circulation through the internal combustion engine 12 (FIG. 1). That is, the oil 14 may include a frothy portion (represented generally by 26 in FIG. 8) having a first degree of aeration, and an unadulterated portion (represented generally by 28 in FIG. 8) having a second degree of aeration that is less than the first degree of aeration. Stated differently, the unadulterated portion 28 may be comparatively less-aerated than the frothy portion 26 of the oil 14 and may include comparatively less entrained air than the frothy portion 26. For example, as the oil 14 circulates through the internal combustion engine 12, the oil 14 may be agitated and sheared upon exposure to moving components of the internal combustion engine 12, such as, for example, a crankshaft 90 (FIG. 1) and pistons 92 (FIG. 1). As such, air may become entrained in the oil 14 during circulation of the oil 14 within the internal combustion engine 12 to form the frothy portion 26.

Conversely, referring again to FIG. 1, oil 14 (FIG. 8) disposed within a cylinder head 94 of the internal combustion engine 12 may be comparatively less-aerated than oil 14 disposed in contact with the crankshaft 90 of the internal combustion engine 12. As such, the unadulterated portion 28 (FIG. 8) of the oil 14 may correspond to oil 14 within the cylinder head 94, and the frothy portion 26 (FIG. 8) of the oil 14 may correspond to oil 14 surrounding the crankshaft 90 of the internal combustion engine 12. Moreover, in general, the unadulterated portion 28 may provide better lubrication, thermal energy dissipation, and protection from friction than the frothy portion 26 of the oil 14. Further, as shown generally in FIG. 8, after circulation through the internal combustion engine 12, the unadulterated portion 28 may be disposed between the frothy portion 26 and the floor 20.

Referring now to FIG. 2, the oil pan 10 further includes a wall 30 interconnecting the flange 16 and the floor 20. That is, the wall 30 and the floor 20 may together define a cavity 32 configured for containing the oil 14 (FIG. 8) so that the oil pan 10 is shaped as a generally-rectangular box when the oil pan 10 is attached to the internal combustion engine 12 (FIG. 1).

With continued reference to FIG. 2, the wall 30 defines at least one passage 34 therein. The at least one passage 34 extends from the flange 16 towards the floor 20 to a second distance 36 that is less than the first distance 22. That is, the at least one passage 34 may be configured as a longitudinal recession defined by the wall 30 and may extend from the flange 16 towards the floor 20 along a portion of the wall 30. However, since the second distance 36 is less than the first distance 22, the at least one passage 34 does not extend along an entire height of the wall 30. That is, the at least one passage 34 may not intersect the floor 20.

Referring again to FIG. 2, the oil pan 10 further includes at least one insert 38 insertable into the at least one passage 34 to a third distance 40 that is less than the second distance 36 to thereby define an oil drainback channel 42 that is configured for draining the oil 14 (FIG. 8) from the internal combustion engine 12 (FIG. 1) to the floor 20. More specifically, the oil drainback channel 42 may be configured for draining the unadulterated portion 28 (FIG. 8) of the oil 14 from the cylinder head 94 of the internal combustion engine 12 to the floor 20. That is, the at least one insert 38 may be inserted into the at least one passage 34 to thereby define a conduit, i.e., the oil drainback channel 42, for transmitting oil 14, e.g., the unadulterated portion 28, from the internal combustion engine 12 back to the floor 20 for subsequent pickup and re-circulation through the internal combustion engine 12.

Figure 8:
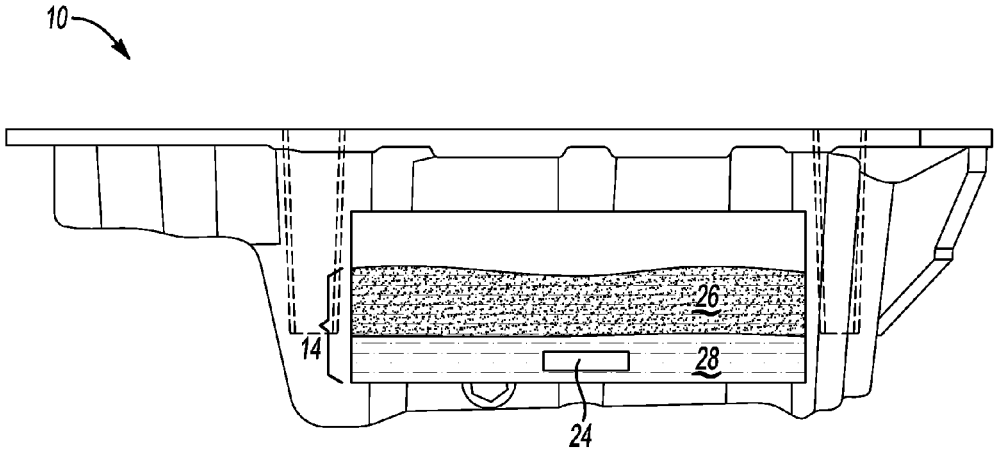
FIG. 8 is a schematic illustration of a side cutaway view of the oil pan of FIGS. 1-3, wherein the oil pan contains a stratified oil.

Further, as best shown in FIG. 2, the third distance 40 is less than the second distance 36. As such, the at least one insert 38 and the floor 20 may define a drain hole 44 configured for transmitting the oil 14, e.g., the unadulterated portion 28 (FIG. 8), from the oil drainback channel 42 to the floor 20. More specifically, when the at least one insert 38 is inserted into the at least one passage 34 as shown in FIG. 2, the at least one insert 38 may have a first end 46 abutting the flange 16, and a second end 48 spaced apart from the first end 46. In particular, the first end 46 may be substantially flush with the flange 16. Therefore, the second end 48 and the floor 20 may together define the drain hole 44 configured for transmitting the oil 14 from the oil drainback channel 42 to the floor 20. As such, as set forth in more detail below, the unadulterated portion 28 of the oil 14 may circulate through the internal combustion engine 12 (FIG. 1) during operation of the internal combustion engine 12 to lubricate moving components within the cylinder head 94 (FIG. 1), dissipate thermal energy, and protect against premature wear and corrosion of ferrous components of the internal combustion engine 12, and then subsequently drain back to the floor 20 of the oil pan 10 through the oil drainback channel 42 without substantially contacting the frothy portion 26 (FIG. 8). That is, the oil drainback channel 42 may minimize mixing of the unadulterated portion 28 and the frothy portion 26 since only the unadulterated portion 28 may travel through the oil drainback channel 42.

Figure 3:
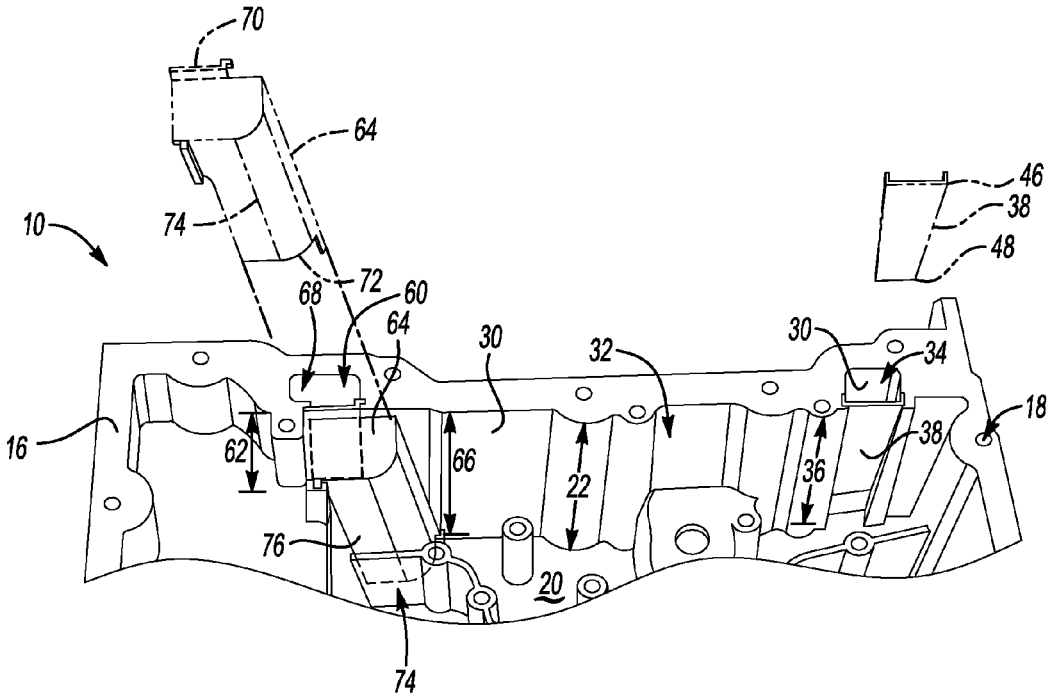
FIG. 3 is a schematic perspective exploded partial illustration of the oil pan of FIGS. 1 and 2, wherein the insert is removable from the respective one of the plurality of passages, and further wherein the auxiliary element is removable from the auxiliary duct.
Figure 4:
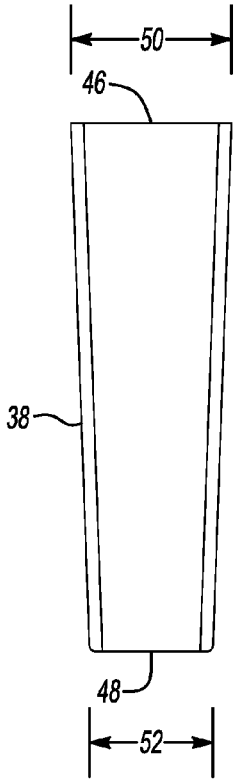
FIG. 4 is a schematic illustration of a plan view of one of the plurality of inserts of FIGS. 2 and 3.
Figure 5:
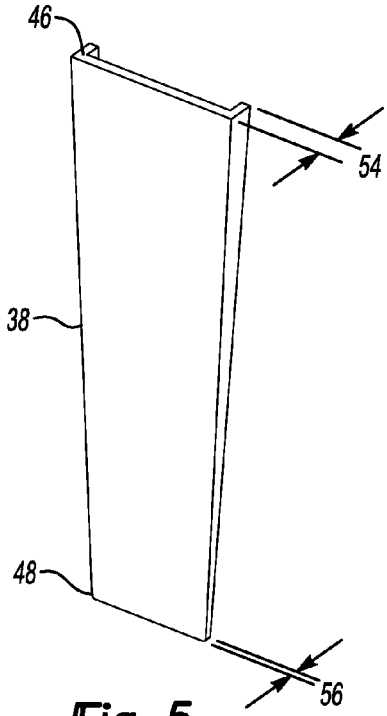
FIG. 5 is a schematic perspective illustration of the insert of FIG. 4.
Figure 6:
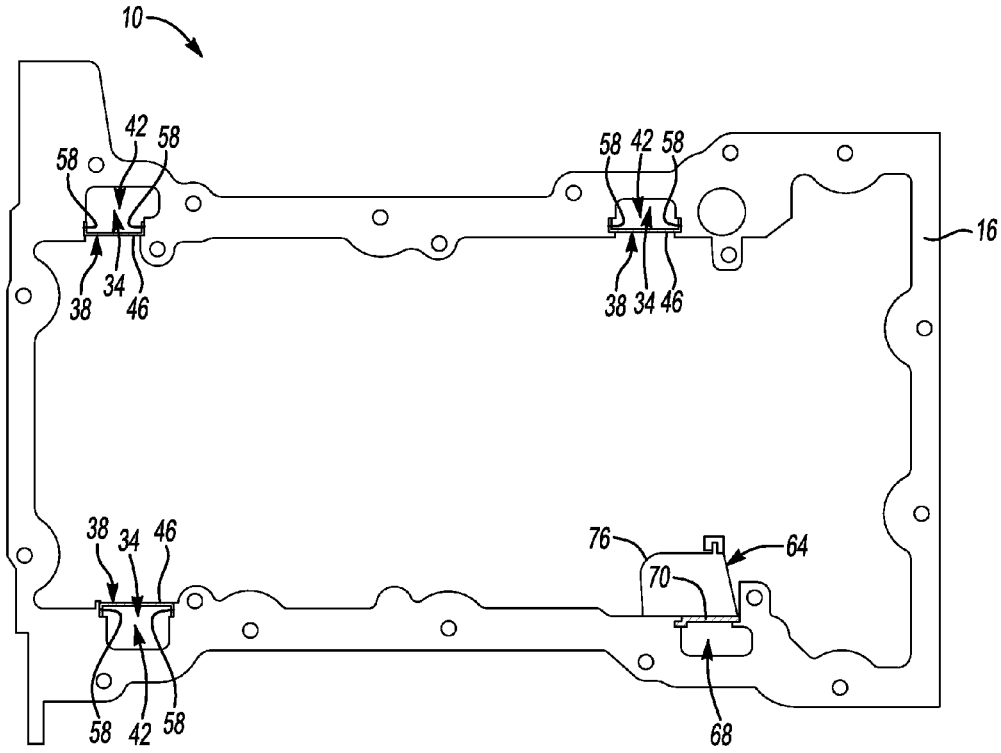
FIG. 6 is a schematic illustration of a top view of the oil pan of FIGS. 1-3.
Figure 7:
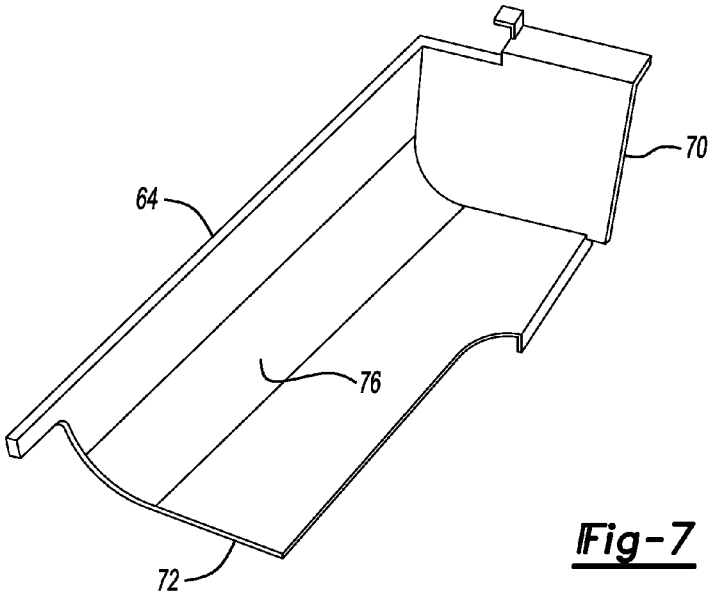
FIG. 7 is a schematic perspective illustration of the auxiliary element of FIGS. 2 and 3.

Referring now to FIG. 4, the at least one insert 38 may have a first width 50 at the first end 46 and a second width 52 at the second end 48 that is less than the first width 50 such that the at least one insert 38 tapers from the first end 46 to the second end 48. In addition, as best shown in FIG. 5, the at least one insert 38 may have a first thickness 54 at the first end 46 and a second thickness 56 at the second end 48 that is less than the first thickness 54. Further, as best shown in FIG. 6, the first end 46 may have a substantially C-shaped cross-section, and the wall 30 may further define two slots 58 within the at least one passage 34 each configured for receiving and guiding the at least one insert 38 into the at least one passage 34. As such, as best shown in FIG. 3, when the at least one insert 38 is inserted into the at least one passage 34, the at least one insert 38 may slope into the at least one passage 34 from the first end 46 to the second end 48. That is, the at least one insert 38 may slant towards the wall 30 and extend into the at least one passage 34. Therefore, in one example, as best shown in FIG. 6, the oil drainback channel 42 may have a substantially D-shaped cross-section. Further, in one non-limiting example, the at least one insert 38 may be formed from nylon, and the wall 30 may be formed from aluminum.

Referring again to FIG. 3, the at least one insert 38 may be removable from the at least one passage 34. For example, the at least one insert 38 may be removed from the at least one passage 34 during maintenance and/or assembly operations.

In one embodiment, as best shown in FIG. 2, the wall 30 may further define a plurality of passages 34 therein, and the oil pan 10 may further include a plurality of inserts 38 configured for insertion into a respective one of the plurality of passages 34 to thereby define a plurality of oil drainback channels 42 each spaced apart from one another along the wall 30 and configured for draining the oil 14 (FIG. 8) from the internal combustion engine 12 (FIG. 1) to the floor 20. For example, as shown in FIG. 3, the plurality of oil drainback channels 42 may be disposed in respective corners of the oil pan 10.

For this embodiment, as described with continued reference to FIG. 2, the wall 30 may define three passages 34 therein, and each of the three passages 34 may extend from the flange 16 towards the floor 20 to the second distance 36 that is less than the first distance 22. In addition, for this embodiment, the oil pan 10 may further include three inserts 38 each insertable into a respective one of the three passages 34 to the third distance 40 that is less than the second distance 36 to thereby define three oil drainback channels 42 each configured for draining the oil 14 from the internal combustion engine 12 to the floor 20. Further, as best shown in FIG. 6, at least one of the three oil drainback channels 42 may have a substantially P-shaped cross-section.

Referring again to FIG. 3, for this embodiment, the wall 30 may further define an auxiliary duct 60 therein, wherein the auxiliary duct 60 extends from the flange 16 towards the floor 20 to an intermediate distance 62 that is less than the second distance 36. That is, the auxiliary duct 60 may be configured as a shortened longitudinal recession as compared to any of the plurality of passages 34, may be defined by the wall 30, and may extend from the flange 16 towards the floor 20 along a comparatively shorter portion of the wall 30, i.e., along the intermediate distance 62. As such, the auxiliary duct 60 may be useful for oil transmission through portions of the oil pan 10 having minimal open space due to, for example, tight tolerances and/or the presence of operational tubing (not shown) or other components (not shown).

In addition, as best shown in FIG. 3, for this embodiment, the oil pan 10 may further include an auxiliary element 64 insertable into the auxiliary duct 60 to a fourth distance 66 that is greater than the intermediate distance 62 and less than the first distance 22 to thereby define an auxiliary oil drainback channel 68 configured for draining the oil 14 (FIG. 8) from the internal combustion engine 12 (FIG. 1) to the floor 20. That is, the auxiliary element 64 may be inserted into the auxiliary duct 60 to thereby define a conduit, i.e., the auxiliary oil drainback channel 68, for transmitting the oil 14 from the internal combustion engine 12 back to the floor 20 for subsequent pickup and re-circulation through the internal combustion engine 12. As such, the unadulterated portion 28 (FIG. 8) of the oil 14 may circulate through the internal combustion engine 12 during operation of the internal combustion engine 12, then subsequently drain back to the floor 20 of the oil pan 10 through the auxiliary oil drainback channel 68.

For example, referring to FIG. 3, when the auxiliary element 64 is inserted into the auxiliary duct 60, the auxiliary element 64 may have a proximal end 70 that abuts the flange 16, and a distal end 72 spaced apart from the proximal end 70. In particular, the proximal end 70 may be substantially flush with the flange 16. Therefore, the distal end 72 and the floor 20 may together define an auxiliary drain hole 74 configured for transmitting the oil 14 (FIG. 8) from the auxiliary oil drainback channel 68 to the floor 20 when the auxiliary element 64 is inserted into the auxiliary duct 60. In addition, when the auxiliary element 64 is inserted into the auxiliary duct 60, the auxiliary element 64 may include a portion 76 extending away from the wall 30 into the cavity 32. That is, the portion 76 may be generally convex with respect to the wall 30 and may be configured for routing the unadulterated portion 28 (FIG. 8) through a portion of the oil pan 10 having minimal open space and/or tight tolerances. In one example, as best shown in FIG. 6, the auxiliary oil drainback channel 68 may have a substantially P-shaped cross-section.

Therefore, during operation of the internal combustion engine 12 (FIG. 1), the oil pan 10 minimizes aeration of the oil 14 (FIG. 8) and mixing of the frothy portion 26 (FIG. 8) and the unadulterated portion 28 (FIG. 8). More specifically, the oil drainback channels 42 (FIG. 2) and auxiliary oil drainback channel 68 (FIG. 2) are each configured to drain the unadulterated portion 28 of the oil 14 to the floor 20 without mixing the unadulterated portion 28 and the frothy portion 26. For example, the unadulterated portion 28 may be directed from the cylinder head 94 (FIG. 1) directly to the floor 20 of the oil pan 10 and may be protected from increased aeration. Such minimized aeration in turn minimizes friction between moving components of the internal combustion engine 12, and therefore maximizes efficiency of the internal combustion engine 12 during operation. In addition, the oil drainback channels 42 and auxiliary oil drainback channel 68 may minimize starvation of the internal combustion engine 12 due to over-aerated oil.

While the best modes for carrying out the disclosure have been described in detail, those familiar with the art to which this disclosure relates will recognize various alternative designs and embodiments for practicing the disclosure within the scope of the appended claims.

The invention claimed is:

1. An oil pan for an internal combustion engine, the oil pan comprising:

a flange configured for attaching to the internal combustion engine;

a floor spaced apart from the flange by a first distance and configured for collecting an oil thereon;

a wall interconnecting the flange and the floor and defining at least one passage therein, wherein the at least one passage extends from the flange towards the floor to a second distance that is less than the first distance; and at least one insert insertable into the at least one passage to a third distance that is less than the second distance to thereby define an oil drainback channel that is configured for draining the oil from the internal combustion engine to the floor.

2. The oil pan of claim 1, wherein the at least one insert is inserted into the at least one passage and has a first end abutting the flange and a second end spaced apart from the first end, and further wherein the second end and the floor together define a drain hole configured for transmitting the oil from the oil drainback channel to the floor.

3. The oil pan of claim 2, wherein the at least one insert slopes into the at least one passage from the first end to the second end.

4. The oil pan of claim 2, wherein the at least one insert has a first width at the first end and a second width at the second end that is less than the first width such that the at least one insert tapers from the first end to the second end.

5. The oil pan of claim 4, wherein the at least one insert has a first thickness at the first end and a second thickness at the second end that is less than the first thickness.

6. The oil pan of claim 4, wherein the first end has a substantially C-shaped cross-section.

7. The oil pan of claim 6, wherein the oil drainback channel has a substantially D-shaped cross-section.

8. The oil pan of claim 1, wherein the wall further defines two slots within the at least one passage each configured for receiving and guiding the at least one insert into the at least one passage.

9. The oil pan of claim 1, wherein the at least one insert is removable from the at least one passage.

10. The oil pan of claim 1, wherein the wall is formed from aluminum and the at least one insert is formed from nylon.

11. The oil pan of claim 1, wherein the wall further defines a plurality of passages therein, and wherein the oil pan further includes a plurality of inserts configured for insertion into a respective one of the plurality of passages to thereby define a plurality of oil drainback channels each spaced apart from one another along the wall and configured for draining the oil from the internal combustion engine to the floor.

12. An oil pan for an internal combustion engine, the oil pan comprising:

a flange configured for attaching to the internal combustion engine;

a floor spaced apart from the flange by a first distance and configured for collecting an oil thereon;

a wall interconnecting the flange and the floor and defining:

three passages therein, wherein each of the three passages extends from the flange towards the floor to a second distance that is less than the first distance; and an auxiliary duct therein, wherein the auxiliary duct extends from the flange towards the floor to an intermediate distance that is less than the second distance;

three inserts each insertable into a respective one of the three passages to a third distance that is less than the second distance to thereby define three oil drainback channels each configured for draining the oil from the internal combustion engine to the floor; and an auxiliary element insertable into the auxiliary duct to a fourth distance that is greater than the intermediate distance and less than the first distance to thereby define an auxiliary oil drainback channel configured for draining the oil from the internal combustion engine to the floor.

13. The oil pan of claim 12, wherein the auxiliary element is inserted into the auxiliary duct and has a proximal end configured for abutting the flange and a distal end spaced apart from the proximal end, and further wherein the distal end and the floor together define an auxiliary drain hole configured for transmitting the oil from the auxiliary oil drainback channel to the floor.

14. The oil pan of claim 13, wherein the wall and the floor together define a cavity configured for containing the oil, and further wherein the auxiliary element is inserted into the auxiliary duct and includes a portion extending away from the wall into the cavity when the auxiliary element is inserted into the auxiliary duct.

15. The oil pan of claim 12, wherein at least one of the three oil drainback channels has a substantially P-shaped cross-section.

16. The oil pan of claim 15, wherein the auxiliary oil drainback channel has a substantially P-shaped cross-section.

17. An oil pan for an internal combustion engine, the oil pan comprising:

a flange configured for attaching to the internal combustion engine;

a floor spaced apart from the flange by a first distance and configured for collecting an oil thereon, wherein the oil includes:

a frothy portion having a first degree of aeration; and an unadulterated portion disposed between the frothy portion and the floor and having a second degree of aeration that is less than the first degree of aeration;

a wall interconnecting the flange and the floor such that the floor and the wall together define a cavity configured for containing the oil, wherein the wall defines at least one passage therein extending from the flange towards the floor to a second distance that is less than the first distance; and at least one insert insertable into the at least one passage to a third distance that is less than the second distance to thereby define an oil drainback channel that is configured for draining the unadulterated portion from the internal combustion engine to the floor;

wherein the at least one insert has a first end that abuts the flange when the at least one insert is inserted into the at least one passage, and a second end spaced apart from the first end;

wherein the second end and the floor together define a drain hole configured for transmitting the unadulterated portion from the oil drainback channel to the floor when the at least one insert is inserted into the at least one passage.

18. The oil pan of claim 17, wherein the oil drainback channel minimizes mixing of the unadulterated portion and the frothy portion.

* * * * *